US008640517B2

(12) United States Patent
Inoue et al.

(10) Patent No.: US 8,640,517 B2
(45) Date of Patent: Feb. 4, 2014

(54) METHOD FOR FEEDING LUBRICANT DURING A HOT ROLLING PROCESS

(75) Inventors: Tsuyoshi Inoue, Futtsu (JP); Guy Hauret, Fos sur Mer (FR)

(73) Assignee: Arcelor France, Saint Denis (FR)

( * ) Notice: Subject to any disclaimer, the term of this patent is extended or adjusted under 35 U.S.C. 154(b) by 1370 days.

(21) Appl. No.: 11/719,704

(22) PCT Filed: Nov. 21, 2005

(86) PCT No.: PCT/FR2005/002891

§ 371 (c)(1),
(2), (4) Date: Feb. 7, 2008

(87) PCT Pub. No.: WO2006/053996

PCT Pub. Date: May 26, 2006

(65) Prior Publication Data

US 2009/0151415 A1 Jun. 18, 2009

(30) Foreign Application Priority Data

Nov. 19, 2004 (JP) ..... 2004-336514

(51) Int. Cl.
*B21B 27/06* (2006.01)
*B21B 45/02* (2006.01)

(52) U.S. Cl.
USPC ..... 72/236; 72/41

(58) Field of Classification Search
USPC ..... 72/41–45, 236
See application file for complete search history.

(56) References Cited

U.S. PATENT DOCUMENTS

| | | | | |
|---|---|---|---|---|
| 1,927,496 | A * | 9/1933 | Hilgerink | 134/36 |
| 3,605,473 | A | 9/1971 | Lyon et al. | |
| 3,835,052 | A | 9/1974 | McDole et al. | |
| 3,970,569 | A | 7/1976 | Sturwold et al. | |
| 5,090,225 | A * | 2/1992 | Schimion | 72/45 |

FOREIGN PATENT DOCUMENTS

| | | |
|---|---|---|
| DE | 1427803 | 4/1969 |
| JP | 10 158679 | 6/1998 |

OTHER PUBLICATIONS

Naoki Kihara and Hajime Ihara, "Development of Hot Rolling Oil" published in the Proceeding of the First International Conference on Tribology in Manufacturing processes 1997, Gifu pp. 393-396.
"A discussion of the coordinated application of roll gap lubrication, work roll cooling and anti-peeling systems in hot rolling mills", A RGL_AISE_2003_report presented in the Article "Iron and Steel Technology", pp. 27-36.

* cited by examiner

*Primary Examiner* — Teresa M Ekiert
(74) *Attorney, Agent, or Firm* — Davidson, Davidson & Kappel, LLC

(57) ABSTRACT

The invention relates to a method for feeding lubricant during hot rolling, in which the surfaces of the rolling rolls are fed with a lubricating emulsion, characterized in that said lubricating emulsion, consisting of a lubricating oil having a viscosity between 10 cSt and 400 cSt at 40° C., mixed with water, is directed onto the surfaces of the rolling rolls via at least one lubricant feed nozzle, at a temperature above 0° C. but below 25° C.

4 Claims, 1 Drawing Sheet

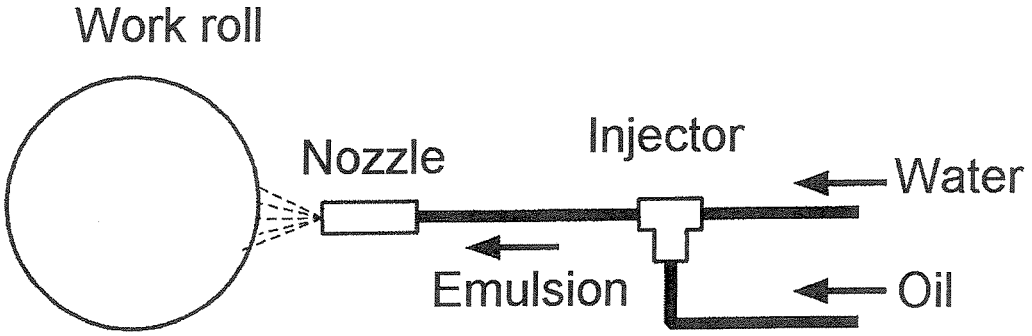
Work roll
Nozzle
Injector
Water
Emulsion
Oil

METHOD FOR FEEDING LUBRICANT DURING A HOT ROLLING PROCESS

The present invention relates to a method for feeding lubricant during hot rolling.

During hot rolling, a lubricant is delivered to the surfaces of the rolling rolls so as to reduce the friction forces that act on the zones between the rolling rolls and the rolled material, or else to prevent the wear and sticking of the rolls of the rolling mill, thus producing steel products of high surface quality. Lubricants and methods of feeding them are known, in particular (a) a method in which a lubricating oil is mixed with water and the lubricant is in the form of an emulsion, which is then delivered by injection or by any other similar method, and (b) a vapor atomization method in which a lubricating oil and vapor are mixed together and the mixture is delivered by injection, and (c) an atomization method in which a lubricating oil is atomized by employing air, a gas, etc.

Method (a) above has hitherto been frequently employed. In this method (a), the equipment used is relatively simple and the time required to replace a lubricating oil is short. Furthermore, because the water and a lubricating oil are mixed together, in addition to the lubrication effect, a roll cooling effect may be expected owing to the water of the lubricant. For this reason, method (a) is the one most commonly employed.

Incidentally, during hot rolling the thickness of the strip of a rolled material is large compared to that obtained as a result of cold rolling, and the rolling mill is not provided with a device for facilitating engagement of the rolled materials. For this reason, slippage during engagement of the strip at the entry of the rolls, and also during rolling, may occur.

To solve this problem, a method may be used in which the amount of lubricating oil fed is reduced, and lubricating oil is fed until slippage problems appear. It is also possible to use a method in which the slippage at engagement between the rolls is avoided by not lubricating at all when the start and finish ends of the rolled material are engaged in the rolling mill.

Moreover, a method is known in which a lubricant is obtained by emulsifying a lubricating oil having a high friction coefficient and by using it in order for slippage at engagement between the rolls not to occur when the start and finish ends of the rolled material are engaged in the rolling mill.

However, if lubrication is used during rolling, although operators fear that slippage might occur, it proves to be impossible to obtain a suitable lubrication effect. Furthermore, even when the friction coefficient of a lubricant is carefully chosen, slippage problems continue to occur.

It might be thought that this is due to the fact that the ambient temperature around the rolling mill is not constant, partly because of seasonal temperature variation factors, with the result that the temperature during lubricating oil feed does not remain constant, the viscosity of the lubricating oil varies, and, even with the same amount fed, the amount of lubricating oil that actually adheres to the rolling mill rolls varies.

Moreover, if the viscosity of a lubricating oil is increased and its adhesion to the rolling rolls is improved, in order to eliminate variations in the amount of lubricating oil that adheres, then the lubricating oil adheres to the internal wall of the lubricating oil feed pipework, fouling it or even blocking it. This fouling of the pipework also generates unexpected variations in the concentration of the lubricating oil.

Furthermore, the inside of an injector in which the lubricating oil is mixed with water has an orifice structure and the lubricating oil passes through a pipe of small inside diameter.

A large-capacity pump is required for a high-viscosity fluid (the lubricating oil) to be able to pass through this pipe of small inside diameter.

Therefore, even though a lubricating oil should be replaced with a high-viscosity lubricating oil, it may sometimes be impossible to change the lubricating oil because of restrictions in terms of the equipment, such as a pump.

There is therefore a need for a lubricant feed method in which a high-viscosity lubricating oil is emulsified without the pipework being fouled, and the lubricating emulsion obtained, which has a high viscosity, is delivered to the rolling mill rolls and, thanks to this, a constant and stable lubrication effect can be achieved without being affected by the ambient temperature.

In view of the abovementioned problems, the object of the present invention is to provide a method of feeding lubricant that achieves a constant lubrication effect without being affected by the ambient temperature, by emulsifying a high-viscosity lubricating oil, but without fouling the pipework, and by feeding the high-viscosity lubricant to the rolling rolls.

The present inventors have solved the abovementioned problems by a method for emulsifying a lubricating oil by injecting water while (a) keeping the lubricating oil in a relatively low viscosity state until the lubricating oil is injected from a nozzle, in order to prevent the pipework being fouled, and (b) modifying the lubricating oil so that it passes to a relatively high viscosity state when the lubricating oil is emulsified and injected by the nozzle, in order to increase the efficiency of adhesion to the rolling mill rolls, said effectiveness being defined as the ratio of the amount of lubricant adhering to the rolling mill rolls to the amount of lubricant delivered by the lubricant feed nozzle.

For this purpose, the subject of the invention is a method for feeding lubricant during hot rolling, in which the surfaces of the rolling rolls are fed with a lubricating emulsion, characterized in that said lubricating emulsion, consisting of a lubricating oil having a viscosity between 10 cSt and 400 cSt at 40° C., mixed with water, is directed onto the surfaces of the rolling rolls via at least one lubricant feed nozzle, at a temperature above 0° C. but below 25° C.

In a preferred embodiment, the lubricating emulsion is cooled in the lubricant feed nozzle to a temperature above 0° C. but below 25° C. and is then directed onto the surfaces of the rolling rolls.

In another preferred embodiment, the method according to the invention is such that the temperature of the lubricating oil contained in the lubricating emulsion is above 20° C. before it is mixed with the water.

In another preferred embodiment, the method according to the invention is such that the temperature of the water contained in the lubricating emulsion is between 0° C. and 25° C. before it is mixed with the lubricating oil.

According to the invention, it is possible to increase the effectiveness with which a lubricating oil adheres to the rolling mill rolls without being affected by the ambient temperature, while eliminating any fouling or blocking of the pipework with the lubricating oil, and by dispensing with the need to substantially modify the current lubrication oils and the lubricating oil feed pipework systems.

The present invention will now be described in detail on the basis of the appended FIGURE, which shows schematically a lubricant feed device of the water injection type.

FIG. 1 shows the diagram of a lubricating oil feed pipework system, which emulsifies a lubricating oil by mixing it with an injection of water, and delivers the emulsified lubricating oil to the rolling mill rolls. This system is the one most commonly employed at the present time in the industry. The invention is based on this system, as a precondition.

In the invention, when a lubricating oil having a viscosity at 40° C. of more than 10 cSt but less than 400 cSt is mixed with water by using an injector of a water injection system in order to obtain a lubricating emulsion, one or other of the following methods may be used:

(i) after a lubricating oil and water have been mixed by the injector, the mixture is cooled to a temperature between 0° C. and 25° C. and is then injected, or else (ii) a lubricating emulsion, obtained by mixing a lubricating oil, preferably at a temperature above 20° C., is mixed with water having a temperature between 0° C. and 25° C. in an injector and is injected by a nozzle at a temperature between 0° C. and 25° C.

In most lubrication oils, changes in viscosity, within the temperature range from 10° C. to 40° C., range from a factor of about two to a factor of about four, this temperature range corresponding to that observed for the temperature of water in winter and in summer.

When the viscosity of a lubricating oil is less than 10 cSt at 40° C., the viscosity at an injection temperature between 0° C. and 25° C. becomes insufficient and the effectiveness of the adhesion to the rolling mill rolls (the ratio of the amount of lubricant adhering to the rolling mill rolls to the amount of lubricant delivered by the lubricant feed nozzle) greatly decreases, with the result that the benefit of a sufficient lubrication effect is impossible to obtain. The lower limit for the viscosity of a lubricating oil at 40° C. is therefore set at 10 cSt.

To benefit from a sufficient lubrication effect, it is preferred for the viscosity of a lubricating oil at 40° C. not to be less than 100 cSt.

Moreover, if the viscosity of a lubricating oil at 40° C. exceeds 400 cSt, this causes the pipework to be fouled and blocked. Furthermore, at ambient temperature (between 0° C. and 25° C.), the lubricating oil becomes semisolid—adopting what is called a grease state—and therefore the lubricating oil can no longer be mixed with water even by the water injection method. In addition, lubrication becomes excessive when mixing is possible, and this generates slippage problems. Therefore the upper limit of the viscosity of a lubricating oil at 40° C. is set at 400 cSt.

Incidentally, lubrication oils having a viscosity at 40° C. in excess of 400 cSt are very little used at the present time.

To be able to mix a lubricating oil with water without causing the pipework to be fouled, it is preferred for the viscosity of the lubricating oil at 40° C. not to exceed 300 cSt.

The invention uses the adhesion properties of lubrication oils for which, the higher the viscosity of the lubricating oil, the more effective it is in adhering to the rolling mill rolls.

In the invention, if the viscosity at 40° C. is at least 10 cSt but at most 400 cSt, then even the lubrication oils currently used may be employed without involving considerable equipment investment (for example increasing the capacity of the pumps, increasing and replacing the pipework equipment) and in addition to this, it is possible to increase the lubrication effect relative to the current level.

As described above, for most lubrication oils, the viscosity changes within the 10° C. to 40° C. temperature range (corresponding to the changes in water temperature in winter and summer) by a factor ranging from about two to about four. The usual practice is to provide a heater and a mixer in the lubricating oil tank and to control the temperature of the lubricating oil so as to keep it at a constant level.

However, the temperature of the water with which a lubricating oil is mixed has hitherto not been controlled and the situation is such that the water is employed at its natural temperature, which changes according to the outside air temperature.

When the water injection mixing method is employed, in many cases less than one part by volume of lubricating oil is mixed per 100 parts by volume of water. In such a case, even if the lubricating oil temperature is controlled and kept at a constant level in a lubricating oil reservoir, the lubricating oil temperature becomes the same as the water temperature immediately after being mixed with the water.

For this reason, the viscosity of the lubricating oil changes as the water temperature changes, with the result that slippage occurs frequently and that a constant lubrication effect over the year cannot be obtained.

Thus, to solve the problem described, the invention provides for the temperature of the lubricating emulsion to be adjusted to a temperature range from 0° C. to 25° C., preferably 0° C. to 15° C., at the moment of injection by a lubricant feed nozzle.

That is to say that, in the invention, by raising the temperature of the lubricating oil to a high level, before the oil reaches the lubricant feed nozzle, in order to prevent fouling of the pipework and ensure good fluidity in the pipework and, moreover, by regulating the temperature of the lubricant when the lubricant is injected by a feed nozzle in a constant low-temperature range, the viscosity of the lubricating oil is kept in a prescribed high viscosity range and the adhesion of the lubricant to the rolls is increased, while at the same time a prescribed amount of lubricant is delivered to the rolling mill rolls without being affected by seasonal factors over the course of the year.

Therefore, according to the invention, the viscosity of the lubricating oil is adjusted at the moment of ejection by the lubricant feed nozzle, and the viscosity of the lubricating oil may be increased without changing the lubricating oil itself. The lubrication effect by the lubricant may therefore be increased without substantially modifying the lubricant feed equipment.

In the most practical embodiment, the water fed into an injector has a temperature between 0° C. and 25° C., a lubricating oil is mixed with this water, and the mixture is injected by a lubricant feed nozzle, the temperature of the mixture being maintained (mixing mode (ii) above). In this embodiment, it is possible to adjust the temperature of the water to be no less than 0° C. but no more than 25° C., to mix the water with a lubricating oil, and to inject and deliver the lubricating emulsion from a lubricant feed nozzle onto the rolling mill rolls. The proportion by volume of lubricating oil ranges from 0.5 to 5 parts per 100 parts of water, and preferably 0.5 to 2 parts of oil per 100 parts of water. In this case, the temperature of the lubricating oil itself decreases in the pipework from the injector to the nozzle, but the ratio of the mixture of lubricating oil in the emulsion is very low. Therefore, even when the temperature of the lubricating oil decreases in this zone, problems such as pipework fouling are less likely to occur.

In another embodiment, the lubricant feed nozzle is provided with a lubricating emulsion cooling function, and the lubricating emulsion of emulsion is injected and mixed after having been cooled to not less than 0° C. but not more than 25° C. (mixed mode (i) above), and preferably not more than 15° C.

In another embodiment, the lubricant feed nozzle is provided with a lubricating emulsion cooling function, the lubricating emulsion being emulsified with water having a temperature between 15° C. and 25° C., the emulsion being delivered to the rolling mill rolls after it has been cooled to a temperature between 0° C. and 25° C. (mixing mode (i) above).

In the invention, it is necessary to maintain the temperature of the lubricating emulsion at a temperature above 0° C. This is because, if the temperature of the lubricating emulsion is below 0° C., the water contained in the emulsion freezes and it becomes difficult to deliver in a steady manner the lubricant in the required amount to the rolling mill.

EXAMPLE 1

An illustrative example and an embodiment of the invention will now be described. The experimental conditions mentioned in this example are given by way of indication in order to confirm the applicability and the effects of the invention, but these are in no way limiting.

In the invention, various conditions may be adopted provided that the objective of the invention is met.

A lubricating emulsion was injected and delivered, under the conditions indicated below, to test pieces in the form of plates, which were prepared from a rolled material. The mass of lubricating oil adhering to the surface of the plate was measured and the effect of the temperature of the lubricating emulsion on the effectiveness of adhesion was examined.

Experimental Conditions

- Lubricating oil: commercially available hot-rolling lubricating oil with a viscosity of 120 cSt (at 40° C.)
- Concentration of the emulsion: 0.5% by volume
- Nozzle: commercially available flat-cone type
- Feed flow rate: 500 $cm^3$/minute
- Feed pressure: 0.15 MPa (immediately before injection by the nozzle)
- Feed time: 60 seconds
- Test piece: high-speed steel material for hot rolling, measuring 100 mm in width by 1 mm in thickness by 100 mm in length
- Temperature of the lubricant at the moment of injection by the nozzle: 0° C., 5° C., 10° C., 150° C., 20° C., 25° C., 30° C.

Results of the Tests

The amount of lubricating oil adhering to the surface of the test piece at each lubricating oil temperature was measured and the results of the measurement were converted taking as base a value of 100 for the amount of lubricating oil adhering for a lubricating emulsion temperature of 30° C. at the moment of injection by the nozzle. Table 1 gives the results of these tests.

On reading Table 1, it may be seen that the amount of adherent lubricating oil may be considerably increased by adjusting the lubricating oil temperature to be not less than 0° C. but not more than 25° C. Therefore, even if the same lubricating oil as that usually employed is used, the lubrication effect can be easily increased by controlling the temperature of the lubricating oil according to the invention.

TABLE 1

| Temperature (° C.) | 0 | 5 | 10 | 15 | 20 | 25 | 30 |
|---|---|---|---|---|---|---|---|
| Adhesion effectiveness (%) | 240 | 213 | 174 | 149 | 110 | 106 | 100 |

EXAMPLE 2

A strip of material was rolled using a lubricating emulsion delivered to the surfaces of the rolling rolls by controlling its temperature and by using an existing pipework system for feeding lubricating oil. These tests were carried out so as to check whether slippage upon engagement in the rolls or fouling of the pipework took place.

Experimental Conditions

- Lubricating oil: commercially available hot-rolling lubricating oil with a viscosity of 140 cSt (at 40° C.)
- Concentration of the emulsion: 0.7% by volume
- Nozzle: commercially available flat-cone type
- Feed flow rate: 800 $cm^3$/minute
- Feed pressure: 0.2 MPa (immediately before injection by the nozzle)
- Feed duration: before the start of rolling until completion of the rolling (before the material has left the rolls)
- Rolls: high-speed steel roll material for hot rolling, as a bar 100 mm in length and 400 mm in diameter
- Temperature of the lubricant at the moment of injection by the nozzle: 0° C., 5° C., 10° C., 15° C., 20° C., 25° C., 30° C.
- Material: low-carbon steel plate (10 mm in thickness, 100 mm in width and 300 mm in length)
- Rolling speed: 10 m/minute
- Reduction: 20%.

Results of the Tests

It was observed that no slippage occurred and that a satisfactory reduction in the rolling force was obtained.

TABLE 2

| Temperature (° C.) | 0 | 5 | 10 | 15 | 20 | 25 | 30 |
|---|---|---|---|---|---|---|---|
| Slippage | No | No | No | No | No | No | No |
| Decrease in rolling force (%) | 78 | 80 | 82 | 84 | 93 | 97 | 100 |

The decrease in rolling force is expressed by assuming that the rolling force at a lubricant temperature of 30° C. is 100.

As described above, according to the invention, it is possible to increase the effectiveness of a lubricating oil to adhere to the rolling mill rolls without being affected by the ambient temperature, while still preventing the pipework from being blocked by the lubricating oil, in a lubricating oil feed pipework system, and dispensing with the need to modify the existing lubrication oils and the lubricating oil feed pipework systems.

Thus, it is possible to expect a cost reduction, by reducing the consumption of lubricating oil, and an improvement in productivity, by having a stable lubrication effect.

The invention claimed is:

1. A method for feeding lubricant during hot rolling, in which the surfaces of the rolling rolls are fed with a lubricating emulsion, comprising the steps of:

providing a lubricating oil having a viscosity between 10 cSt and 400 cSt at 40° C., whereby the lubricating oil will not cause pipe fouling, mixing the lubricating oil with water to provide a lubricating emulsion, controlling the temperature of the lubricating emulsion to be a constant temperature above 0° C. but below 25° C., and directing the lubricating emulsion having the constant temperature above 0° C. but below 25° C. onto the surfaces of the rolling rolls via at least one lubricant feed nozzle, wherein less than one part by volume of lubricating oil is mixed in said mixing step with 100 parts by volume of water, whereby the lubricating oil will sufficiently adhere to the roll to lubricate the rolls.

2. The method for feeding lubricant during hot rolling as claimed in claim 1, wherein said step of controlling the temperature of the lubricating emulsion comprises cooling said lubricating emulsion in said lubricant feed nozzle to a constant temperature above 0° C. but below 25° C.

3. The method for feeding lubricant during hot rolling as claimed in claim 1, wherein said step of controlling the temperature of the lubricating emulsion comprises controlling the temperature of the water to be a constant temperature between 0° C. and 25° C.

4. The method for feeding lubricant during hot rolling as claimed in claim 1, wherein said step of controlling the temperature of the lubricating emulsion further comprises controlling the temperature of the lubricating oil to be above 20° C. before it is mixed with the water.

* * * * *